United States Patent [19]

Sporenberg et al.

[11] Patent Number: 4,770,227

[45] Date of Patent: Sep. 13, 1988

[54] APPARATUS FOR THE PRODUCTION OF CAST METAL STRIP OF AMORPHOUS AND/OR COMPACT GRAINED STRUCTURES

[75] Inventors: Willi Sporenberg, Hemer; Horst Schenk, Dortmund; Werner Sattler, Iserlohn, all of Fed. Rep. of Germany

[73] Assignee: Sundwiger Eisenhutte Machinenfabrik Grah & Company, Hemer-Sundwig, Fed. Rep. of Germany

[21] Appl. No.: 81,991

[22] Filed: Aug. 5, 1987

[30] Foreign Application Priority Data

Aug. 6, 1986 [DE] Fed. Rep. of Germany ..... 3626638

[51] Int. Cl.[4] ..... B22D 11/06

[52] U.S. Cl. ..... 164/423; 164/417; 242/78.3

[58] Field of Search ..... 164/423, 429, 463, 479, 164/417, 476; 242/56 A, 78.1, 78.3

[56] References Cited

U.S. PATENT DOCUMENTS 2,942,796 6/1960 Gurney et al. ..... 242/56 A
3,853,279 12/1974 Gerstein ..... 242/56 A X
4,518,029 5/1985 Shibuya et al. ..... 164/463

FOREIGN PATENT DOCUMENTS 57-39030 3/1982 Japan ..... 242/78.1
57-79053 5/1982 Japan ..... 164/463

*Primary Examiner*—Kuang Y. Lin
*Attorney, Agent, or Firm*—Kerkam, Stowell, Kondracki & Clark

[57] ABSTRACT

The invention relates to an apparatus for the production of cast metal strip of amorphous and/or compact grained structures. To enable the strip to be coiled on reels at high strip speeds, the strip 6 is guided at the outlet of the casting apparatus 1–6 having a casting wheel 4 over a first and second strip guide channel. The first strip guide channel is formed by at least one cooling wheel 9, 11 and a guide wall 10, 12 disposed concentrically of the cylindrical surface of the cooling wheel 9, 11. By means of a cooling medium the strip is forced against the cylindrical surface of the cooling wheel 9, 11 and thereby intensively cooled at a high conveying speed and without tensile stress. When it leaves the or each cooling wheel 9, 11 the strip 6 is strong enough to pass freely guided through the perpendicularly disposed second guide channel 14. Disposed at the outlet of the guide channel 14 is a gripping device 16 which seizes the strip 6, so that the strip guide channel 14 is no longer required for guidance and is therfore removed. By means of a contact pressure and parting device 24 movable against the strip 6, the strip can be forced with uninterrupted conveying against a coiling reel 19, 20 and be glued on by means of an adhesive coating. Preferably a roller device 29 to 34 is associated with the cooling wheel 11 in the first guide channel.

17 Claims, 3 Drawing Sheets

APPARATUS FOR THE PRODUCTION OF CAST METAL STRIP OF AMORPHOUS AND/OR COMPACT GRAINED STRUCTURES

The invention relates to an apparatus for the production of cast metal srips of amorphous and/or compact grained structures having: a casting apparatus with which molten liquid metal can be applied via a casting nozzle to a moving cooling member; a coiling reel having ancillary coiling-on means; and guide and conveying means disposed between the casting apparatus and the coiling apparatus which form a strip guide channel and have blowing nozzles by which a gaseous, cooling medium plays on the strip.

BACKGROUND OF THE INVENTION

In one prior art apparatus of the kind specified the cast strip between two casting wheels is subjected to tensile stress strength by driving rollers disposed immediately downstream of a casting wheel that the strip is drawn tightly against the cooled cylindrical surface of the casing wheel. The intention is to accelerate cooling. However, the tensile stress can be applied only when the strip has acquired adequate tensile strength due to the cooling. To this end a gaseous cooling medium is also played onto the strip on the free side in the zone of the casing wheels. Until the strip is guided in contact with the driving rollers, and guided between the cooling wheel and the coiling reel floatably between the jets of blowing nozzles disposed on both sides of the strip. Blowing nozzles are also disposed in the zone of the coiling reel and blow a cooling gaseous medium on to the free side of the strip (European Pat. No. 0 081 175 B1).

Since in that apparatus particularly intensive contact cooling takes place only in the zone of the casting wheel, high casting speeds cannot be achieved, more particularly since even the zone of the casting wheel solidification must have progressed far enough for the strip to be capable of absorbing the tensile stress applied by the driving rollers. Another disadvantage of the prior art apparatus is that no provisions are made for lateral guiding of the strip during coiling. Merely playing on the strip radially with the gaseous medium in the direction of the generated surface of the coiling reel does not achieve aligned coiling. Nor are any provisions made for continuous coiling—i.e., a changeover from a full coiling reel to an empty reel with uninterrupted strip conveying.

BRIEF DESCRIPTION OF THE INVENTION

It is an object of the invention to provide a coiling device of the kind specified which allows accurate coiling at high strip speeds.

This object is achieved according to the invention by the following features:

(a) The first portion of the strip guide channel downstream of the casting apparatus is formed by at least one cooling wheel and a wall disposed concentrically of the cylindrical surface of the cooling wheel the blowing nozzles associated with this portion being directed against the strip supported on the cylindrical surface of the cooling wheel.

(b) This first portion of the strip guide channel is adjoined by a substantially perpendicular second portion, whose width perpendicular to the plane of the strip is smaller than the width of the strip and which can be moved from its operating position to release the strip.

(c) Disposed at the end of the second portion of the strip guide channel is an intercepting device for the strip.

(d) The coiling reel and the intercepting device can be adjusted in relation to one another perpendicularly of the direction of strip travel and/or parallel with the plane of the strip.

(e) A strip transferring and parting device can be adjusted against the coiling reel.

Due to the multiple intensive contact cooling, the strip is cooled quickly and without loading by the tensile stresses, cooling also takes place in the zone of the cooling wheel by the gaseous medium of the blowing nozzles disposed in that zone. The gaseous medium of the blowing nozzles forces the strip free from tensile stress against the cooling wheel. Driving rollers which load the strip are not required. Even in the zone of the second portion of the conveying distance the strip is not subjected to loading comparable to the tensile stress exerted by driving rollers. At that place it is conveyed by its own weight or at most additionally by the flow of the gaseous medium. Due to the narrowness of the guide channel and the flow of the gaseous medium which preferably assists conveying, even very thin strip can be conveyed without problems. There is no risk that the strip might run displaced laterally in the channel, since the intercepting device seizes the start of the strip, whereafter alignment with the coiling reel can be achieved be relative adjustment of the coiling reel and the intercepting device. The strip transferring and parting device enables the strip when aligned with the coiling reel by the intercepting device to be connected to the reel without interrupting strip conveying.

The apparatus can be advantageously embodied with a number of features.

For guiding and conveying the strip, more particularly at the beginning, one component of the blowing direction of the blowing nozzles should point in the strip conveying direction.

If a number of cooling wheels having concentrically arranged walls are provided in the first portion of the strip guide channel, they should be disposed after the fashion of pairs of S-rollers.

Trouble with threading-in the initial portion of the strip can be reliably avoided if the distance of each wall from the generated surface of the cooling wheels is smaller than the width of the strip. In that case the strip cannot twist.

A number of steps can be provided for releasing the strip from the casting wheel and transferring it to the following cooling wheel. For example, a strip releasing member can be disposed in the gusset of the cylindrical surface of the casting wheel and the strip. The strip releasing member can comprise a wedge which is more particularly equipped with blowing nozzles. A contact pressure roller for the strip should be provided upstream of the inlet of the channel formed by the first cooling wheel and its wall. The contact pressure roller can be constructed in the form of a roller-shaped brush which is driven by friction rollers running on the generated surface of the cooling wheel.

Preferably a suction device connected to the end of the channel produces the flow through the strip guide channel in the conveying direction. However it is also possible to arrange in the walls of the channel blowing nozzles whose direction of flow has a component pointing in the direction of the channel end.

The intercepting device preferably comprises a pair of clamping rollers whose rollers can be moved apart to intercept the strip. The clamping rollers should be driven, so that the strip is kept taught when connected to the reel and parted.

At the high strip speeds of approximately 40 m/sec aimed at by the apparatus according to the invention, it is particularly problematic to connect the start of the srip to the coiling reel. The possibility of intercepting the start of the strip and aligning the reel and intercepting device with one another creates the precondition enabling the strip to be connected during its travel to the coiling reel. For this purpose a contact pressure and parting device for the strip is associated with the coiling reel, equipped with a gluing means, on the side opposite the strip guiding plane. A suitable gluing means is an adhesive coating. Preferably, the contact pressure and parting device which can be moved against the coiling reel comprises a brush and a knife which is connected downstream in the direction of strip travel and can be hinged away, so as not to damage the strip to be coiled. In this embodiment it is possible to use with the coiling device a turning reel which enables the strip to be transferred in motion from the full reel to the empty reel.

Another roller device, for example, a set of reducing or levelling rollers can also be integrated in the apparatus according to the invention, more particularly on a cooling wheel, more particularly the second cooling wheel.

BRIEF DESCRIPTION OF THE DRAWINGS

The invention will now be described in greater detail with reference to the drawings, wherein.

DETAILED DESCRIPTION OF THE INVENTION

Figure 1:
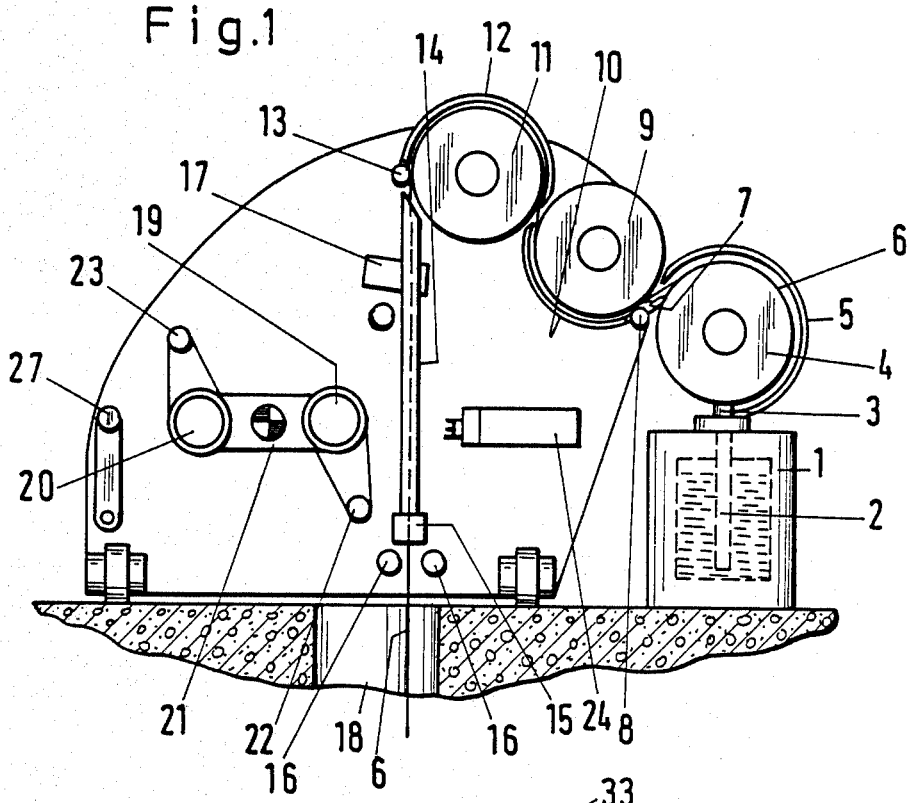
FIG. 1 is a diagrammatic side elevation of an apparatus for producing cast strip, prior to connection to a coiling reel

A strip casting apparatus comprises a tank 1 filled with molten liquid metal, a conveying tube or riser 2 immersed in the tank 1, a casting nozzle 3 and a moving cooling member in the form of a cooled casting wheel 4. Strip casting apparatuses of this or similar construction are known. To prevent the strip 6 from being prematurely detached from the cylindrical surface of the casting wheel 4 due to the centrifugal force acting on the strip, a guide 5 disposed concentrically cylindrical surface of the casting wheel 4 extends thereabove and is equipped with blowing nozzles which blow on to the strip 6, thereby forcing it against the cylindrical surface of the casting wheel 4.

This special construction of the casting apparatus is of secondary importance to the invention, which can also be used with different casting plants, for example, casting apparatuses having two casting wheels or casting apparatuses having nozzles for multi-layer casting. (Cf. German Patent Applications P 35 21 778.2 and P 36 02 594.1). The essential feature is merely that the strip 6 has solidified at the place where it is detached from the casting wheel 4. At this place the strip need not yet have adequate tensile strength to allow the application of a pull.

To enable the strip 6 to be more readily detached from the casting wheel 4, disposed in the gusset between the cylindrical surface of the casting wheel 4 and the strip 6 is a wedge-shaped releasing member 7 which can have blowing nozzles to boost detachment. Connected downstream to the releasing member 7 is a brush roller 8 with friction rollers at its ends which run on the cylindrical surface of a first cooling wheel 9. The brush roller 8 forces the strip 6 against the cylindricl surface of the cooling wheel 9, so that more particularly the start of the strip enters without problems the inlet of a guide channel formed by the cylindrical surface of the cooling wheel 9 and a guide wall 10 disposed concentrically in relation thereto. A second cooling wheel 11 with a correspondingly arranged guide wall 12 is disposed downstream of the first cooling wheel 9. The strip 6 is guided in S-shape over the casing wheel 4 and the two cooling wheels 9, 11. The guide walls 10, 12 on the cooling wheels 9, 11 have blowing nozzles which blow a cooling medium against the strip 6, so that for the purpose of intensive contact cooling the strip 6 is forced tightly against the cylindrical surfaces of the cooling wheels 9, 11. The blowing medium used is preferably a cooled medium, more particularly air or an inert gas. This applies more particularly for the blowing medium of the nozzles on the casting wheel 4.

Disposed at the outlet of the guide channel formed by the cylindrical surface of the cooling wheel 11 and the guide wall 12 as an additional guide is a brush roller 13 driven via a frictional wheel running on the cylindrical surface of the cooling wheel 11. A shallow guide channel 14 adjoins the guide channel 11, 12. The width of the guide channel 14 perpendicular to the plane of the strip is smaller than the strip width. The guide channel 14 can comprise a U-section closable by a lateral cover. The strip 6 guided through the channel 14 can be released by the opening of the cover and lateral adjustment.

A measuring device 17 (merely outlined) enables the thickness of the strip 6 to be measured while it is being continuously conveyed.

At the outlet of the substantially vertically extending guide channel 14 a suction device 15 (merely outlined in the drawings) is connected which allows a downward gas flow through the channel which further conveys through the guide channel 14 the strip 6, which is already conveyed by its own weight.

A pair 16 of clamping rollers is provided at the bottom outlet of the guide channel 14. The strip 6, entering between the opened clamping rollers 16, is retained thereby and conveyed in the direction of a scrap collecting container 18. The strip 6 is laterally fixed by tight clamping, so that from that moment onwards the guide channel 14 is no longer required, but can be opened and moved away out of the guide zone. By means of a scanning device (not shown) the position of the strip 6 can then be detected and used for the coiling operation still to be described.

Disposed in the zone of the guide channel 14 is a turning reel 21 which comprises two coiling reels 19, 20 and can be moved axially of the coiling reels 19, 20 and therefore parallel with the plane of the strip and perpendicularly to the direction of strip travel. Associated with each coiling reel 19, 20 at a literal distance is a strip guide roller 22, 23 which guides the strip when reels are being interchanged. The winding spindle of each coiling reel 19, 20 has a gluing means, for example, an adhesive coating, which acts on the strip.

Figures 9, 10:
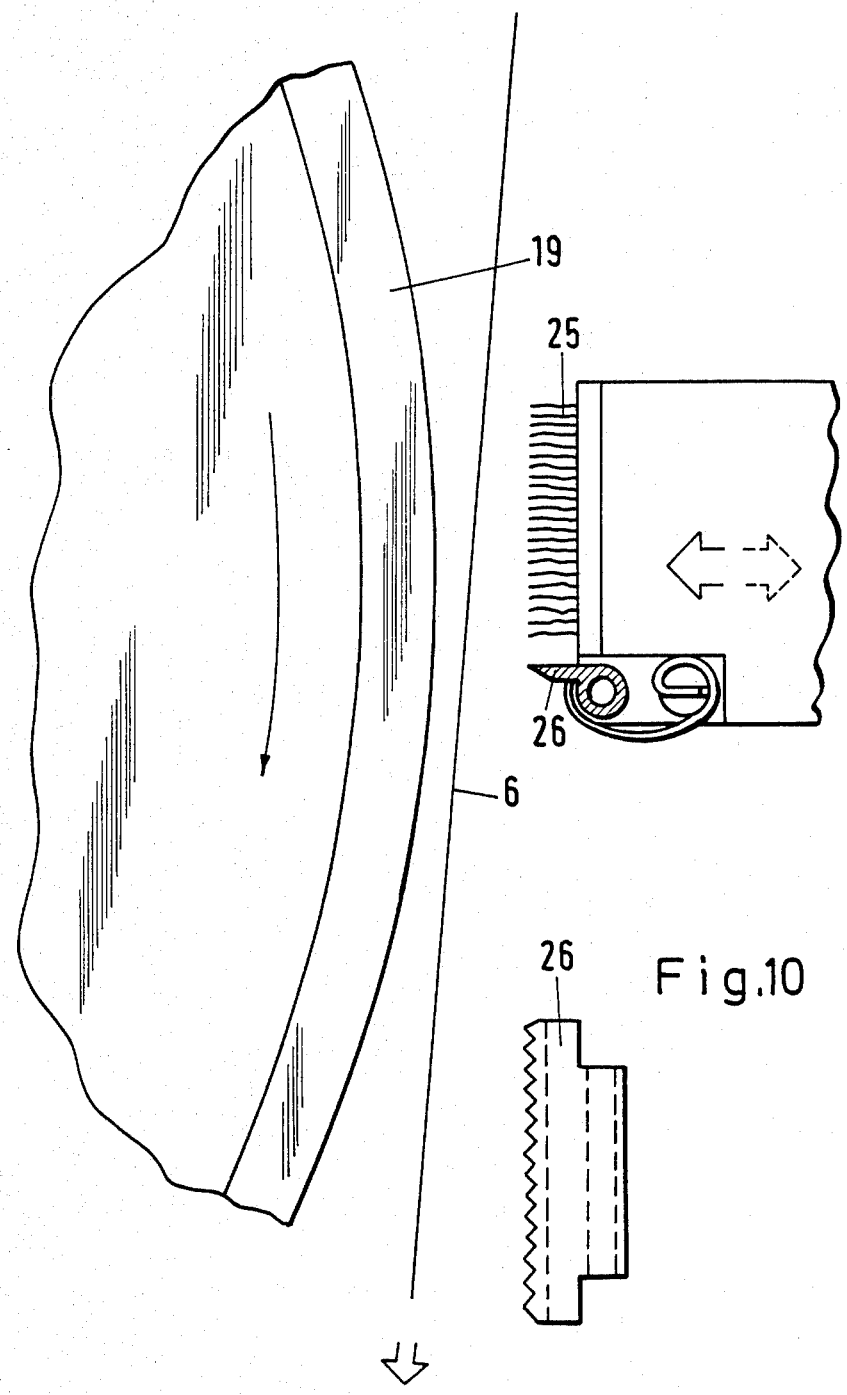
FIG. 9 shows a contact pressure and parting device on a coiling reel of the apparatus illustrated in FIG. 1.
FIG. 10 shows the parting blade of the parting apparatus illustrated in FIG. 9.

Disposed on the side of the strip 6 opposite the coiling reels 19, 20 in the zone of the guide channel 14 is a contact pressure and parting device 24 which, as shown in FIGS. 9 and 10, comprises an advanceable brush-shaped contact pressure member 25 and a toothed blade 26 which can be swing away. By this contact pressure and parting device 24 the strip 6 can be connected to the coiling reel 19 when the latter is in position.

A contact pressure roller 27 which can be pivoted in is associated with the particular coiling reel 19 or 20 in the interchange position.

Figure 8:
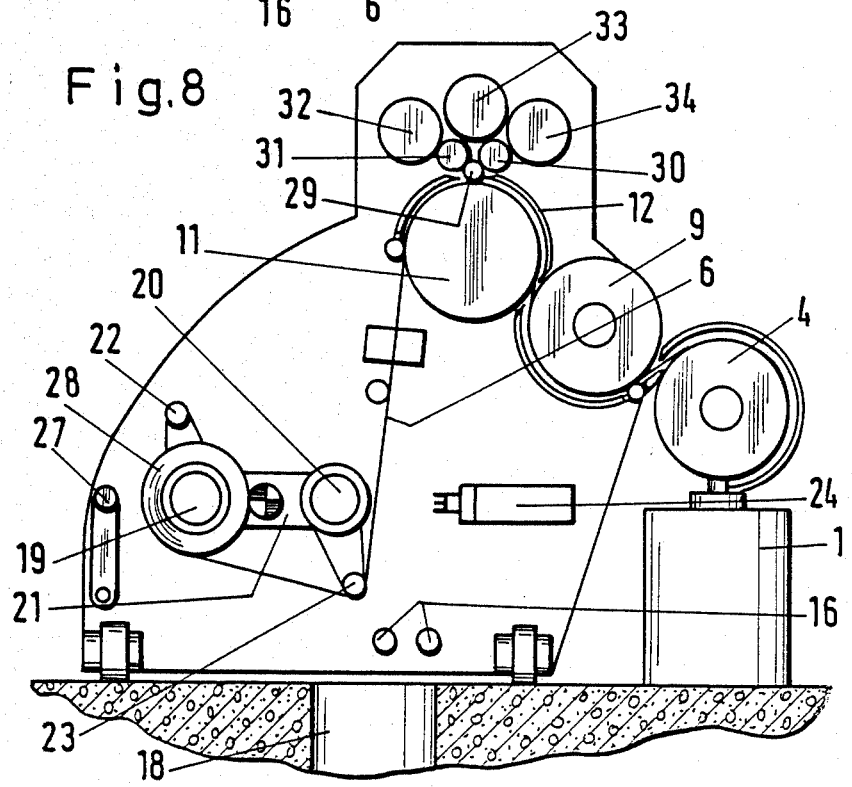
FIG. 8 shows an apparatus as illustrated in FIG. 1 additionally equipped with a roller device, immediately prior to the parting of the strip and its connection to the coiling reel.

In the embodiment illustrated in FIG. 8 the guide wall 12 is formed approximately at the top of the cooling wheel 11 with an opening in which a working roller 29 of a roller device is disposed. The working roller bears via intermediate rollers 30, 31 against supporting rollers 32, 33, 34.

Figure 2:
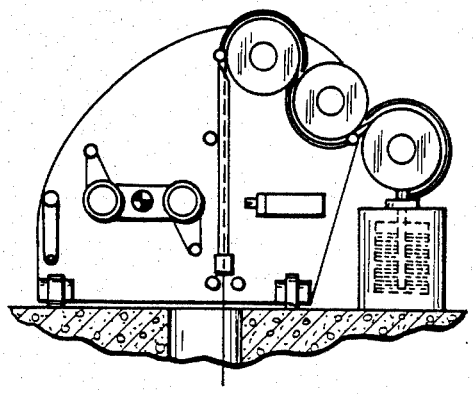
FIGS. 2–7 show the apparatus illustrated in FIG. 1 in various phases of operation.

Using such an apparatus, cast metal strip of amorphous and/or compact grained structure can be produced in the following matter: The molten liquid metal applied to the casting wheel 4 is introduced by means of the releasing member 7 and the brush roller 8 into the first portion of a guide channel formed by cooling wheel 9, 11 and guide walls 10, 12. When it leaves the casting wheel 4, the strip 6 still has very little strength, but is then so high cooled by the cooling wheels 9, 11 that when it leaves the first portion of the guide channel it is solidified enough to be freely guided. The strip then passes through the vertically disposed guide channel 14, from which it enters the scrap collecting container 18. This operational phase is shown in FIGS. 1 and 2.

Figure 3:
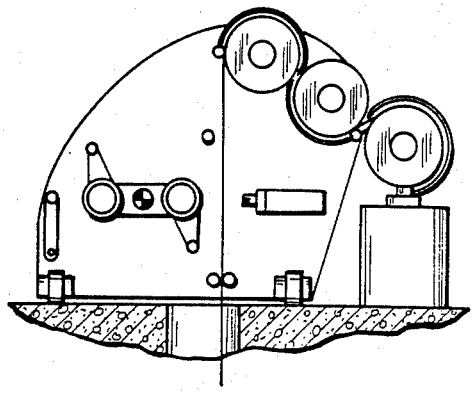

To prepare the connection of the strip to the coiling reel 19, the clamping rollers 16 of the intercepting device are adjusted. The driven clamping rollers 16 take over the guiding of the strip 6, which they keep tightened. The strip guide channel 14 can then be removed. This operational phase is shown in FIG. 3.

Figure 4:
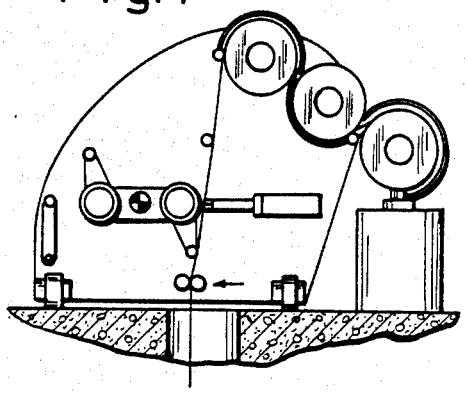

The position of the strip 6 is detected by the appropriate scanning device (not shown). In dependence on the measured result, the strip 6 and the coiling reel 19 are aligned with one another, for example, by the coiling reel 19 being moved axially, the guiding of the strip remaining unchanged. The pair of clamping rollers 16 is then adjusted in the direction of the coiling reel 19 and the contact pressure and parting device 24 is moved against the strip, to glue the strip to the adhesive coating of the coiling reel spindle. The brush 25 makes a wiping movement to apply the moving strip. The hinged, resiliently mounted blade 26 is swung away by the travelling strip 6, whose movement it therefore does not impede. The operational phase of connecting the strip to the reel 19 is shown in FIG. 4.

Figure 5:
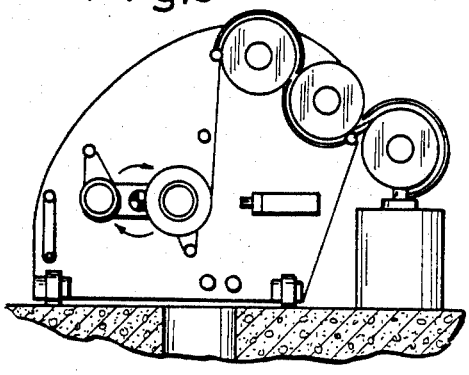

After the connection of the strip, the pair of clamping rollers 16 and the contact pressure and parting device 24 are returned to their inoperative position. The strip 6 is coiled on to the reel 19 until it is full. This operational phase is shown in FIG. 5.

Figure 6:
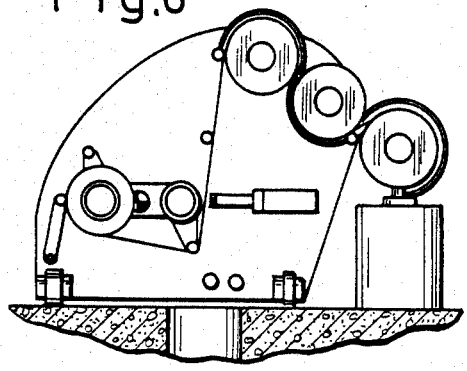

When the coiling reel 19 has been fully wound, the turning reel 21 is pivoted away, so that the empty coiling reel 20 moves into the position of the full reel 19. During this turning operation the conveying of the strip need not be interrupted. The strip still coiled on the reel 19 is after the pivoting operation guided over the guide roller 23, which ensures that the strip 6 is guided substantially perpendicularly past the empty reel 20 to be connected to its spindle. As in the first connection of the strip (FIG. 4), the contact pressure and parting device 24 is actuated again. However, prior to such actuation the pivotable contact pressure roller 27 is forced against the coiled roll 28, so that it remains tightly coiled after the strip has been parted. This operational phase is shown in FIG. 6.

Figure 7:
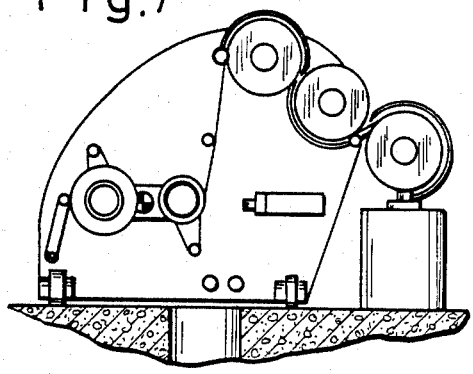

When the strip has been parted and the new start of a strip has been glued to the spindle of the coiling reel 20, the coil 28 can be drawn off the spindle of the coiling reel 19 and be given anew coiling sleeve. This operational phase is shown in FIG. 7.

We claim:

1. An apparatus for the production of cast metal strip a casting apparatus with which molten liquid metal can be applied via a casting nozzle on to a moving cooling member; a coiling reel having ancillary coiling-on means; and guide and conveying means disposed between the casting apparatus and the coiling apparatus which forms a strip guide channel and have blowing nozzles by which a gaseous, more particularly a cooling medium is directed on to the strip, characterized by the following features:

(a) a first portion of the strip guide channel downstream of the casting apparatus formed by at least one cooling wheel and a wall disposed concentrically of the cylindrical surface of the cooling wheel, the blowing nozzles associated with this portion of the apparatus being directed against the strip supported on the cylindrical surface of the cooling wheel;

(b) said portion of the strip guide channel is adjoined by a substantially vertical second portion, whose width perpendicular to the plane of the strip is smaller than the width of the strip and which can be moved from its operating position to release the strip;

(c) disposed at the end of a second portion of the strip guide channel is an intercepting device for the strip;

(d) said coiling reel and the intercepting device adjustable in relation to one another perpendicularly of the direction of strip travel; and (e) a strip contact pressure and parting device can adjusted against the coiling reel.

2. An apparatus according to claim 1, characterized in that a number of cooling wheels have concentrically disposed walls provided after the fashion of pairs of S-rollers in the first portion of the strip guide channel.

3. An apparatus according to claim 2, characterized in that the distance of each wall from the cylindrical surface of the cooling wheels is smaller that the width of the strip.

4. An apparatus according to claim 3, characterized in that the strip releasing member is disposed in the space between the cylindrical surface of the casting wheel and the strip.

5. An apparatus according to claim 4, characterized in that the strip releasing member comprises a wedge equipped with blowing nozzles.

6. An apparatus according to claim 5, characterized in that a contact pressure roller for the strip is provided upstream of the inlet of the channel formed by the first cooling wheel and its wall.

7. An apparatus according to claim 6, characterized in that the contact pressure roller is a roller-shaped brush driven by friction rollers running on the cylindrical surface of the cooling wheel.

8. An apparatus according to claim 7, characterized in that a gaseous medium flows in the conveying direction of the strip through the strip guide channel of the vertical second portion.

9. An apparatus according to claim 8, characterized in that a suction device for producing the flow of gaseous medium in the strip guide channel of the vertical second section is disposed at the end thereof.

10. An apparatus according to claim 9, characterized in that the intercepting device comprises a pair of clamping rollers whose rollers can be moved apart to intercept the beginning of the strip.

11. An apparatus according to claim 10, characterized in that the clamping rollers are movable.

12. An apparatus according to claim 1, characterized in that the coiling device is equipped with a gluing-on means.

13. An apparatus according to claim 12, characterized in that the gluing-on means is an adhesive coating.

14. An apparatus according to claim 13, characterized in that the contact pressure and parting device movable against the coiling reel comprises a brush and blade disposed downstream in the direction of strip travel.

15. An apparatus according to claim 14, characterized in that the blade is hinged.

16. An apparatus according to claim 1 characterized in that the coiling reel is a turning reel.

17. An apparatus according to claim 1, characterized in that disposed between the casting apparatus and the coiling device is a system, of working rollers.

* * * * *